US006659825B2

(12) United States Patent
Foss

(10) Patent No.: US 6,659,825 B2
(45) Date of Patent: Dec. 9, 2003

(54) SELF-INFLATING CHILD FLOATATION DEVICE

(76) Inventor: Jonathan G. Foss, 19765 Chartwell Hill, Shorewood, MN (US) 55331

( * ) Notice: Subject to any disclaimer, the term of this patent is extended or adjusted under 35 U.S.C. 154(b) by 0 days.

(21) Appl. No.: 09/873,846

(22) Filed: Jun. 4, 2001

(65) Prior Publication Data

US 2002/0182950 A1 Dec. 5, 2002

(51) Int. Cl.[7] ..... B63C 9/08
(52) U.S. Cl. ..... 441/123; 441/98
(58) Field of Search ..... 441/122–124, 441/131, 132, 90, 95, 97, 98, 100, 106, 92

(56) References Cited

U.S. PATENT DOCUMENTS

| | | | | | |
|---|---|---|---|---|---|
| 969,439 | A | * | 9/1910 | Archer | 441/123 |
| 1,043,367 | A | * | 11/1912 | Smack | 441/123 |
| 1,138,495 | A | * | 5/1915 | Macaulay | 441/91 |
| 1,385,581 | A | * | 7/1921 | Pallady | 441/123 |
| 1,544,672 | A | * | 7/1925 | Milbury | 441/123 |
| 1,837,089 | A | * | 12/1931 | Wosk | 441/112 |
| 2,536,847 | A | * | 1/1951 | Harrow et al. | 441/93 |
| 2,563,122 | A | * | 8/1951 | Levine | 441/112 |
| 2,742,654 | A | * | 4/1956 | Hurt | 441/118 |
| 2,806,471 | A | * | 9/1957 | Breese | 602/17 |
| 2,869,151 | A | * | 1/1959 | Johnson | 441/96 |
| 2,905,954 | A | * | 9/1959 | Lanciano, Jr. | 441/116 |
| 3,002,203 | A | * | 10/1961 | Moran | 441/118 |
| 3,144,667 | A | * | 8/1964 | Dobbs | 441/93 |
| 3,148,393 | A | * | 9/1964 | McCuaig | 441/92 |
| 3,308,494 | A | * | 3/1967 | Licher | 441/123 |
| 3,426,942 | A | * | 2/1969 | McMains et al. | 222/5 |
| 3,441,964 | A | * | 5/1969 | Koch et al. | 441/118 |
| 3,630,413 | A | * | 12/1971 | Beckes | 222/5 |
| 3,682,354 | A | * | 8/1972 | Witte | 222/3 |
| 3,750,205 | A | | 8/1973 | Pfeifer | |
| 3,925,838 | A | * | 12/1975 | Kennedy | 441/123 |
| 3,931,657 | A | | 1/1976 | Jones | |
| 4,024,440 | A | * | 5/1977 | Miller | 361/251 |
| 4,035,857 | A | * | 7/1977 | Briley et al. | 441/118 |
| 4,276,669 | A | * | 7/1981 | Suba | 441/123 |
| 4,379,705 | A | | 4/1983 | Saotome | |
| 4,800,871 | A | * | 1/1989 | Florjancic | 602/18 |
| 4,840,591 | A | | 6/1989 | Dulin et al. | |
| 5,060,661 | A | * | 10/1991 | Howard | 128/845 |
| 5,184,968 | A | | 2/1993 | Michalochick et al. | |
| 5,421,760 | A | * | 6/1995 | Blaga | 441/123 |
| 5,746,633 | A | * | 5/1998 | Jeffrey | 441/123 |
| 5,779,512 | A | | 7/1998 | Rupert | |
| 5,941,752 | A | | 8/1999 | Liebermann | |
| 6,089,936 | A | | 7/2000 | Hoffman | |
| 6,213,832 | B1 | | 4/2001 | Fest, Sr. | |

FOREIGN PATENT DOCUMENTS

| | | | | |
|---|---|---|---|---|
| FR | 2668748 | * | 5/1992 | 441/123 |

* cited by examiner

*Primary Examiner*—S. Joseph Morano
*Assistant Examiner*—Ajay Vasudeva
(74) *Attorney, Agent, or Firm*—Mark A. Litman & Assoc. P.A.

(57) ABSTRACT

A floatation device, particularly a floatation device for children that can be easily worn, easily positioned, effective in operation, and sufficiently innocuous in appearance comprises an self-inflating tube that is worn around the neck, lies relatively flat against the wearer, and nests under and against the chin when inflated, without pressing tightly against the neck as would restrict breathing. The uninflated device may be plain or decorated and should respond to direct contact with water by inflating within no more than one minute of contact with water, and preferably in less than 15 seconds of contact with water. The device should not inflate nor generate gas when contacted with 85° C. and 98% relative humidity for 15 minutes.

11 Claims, 4 Drawing Sheets

Fig. 3A
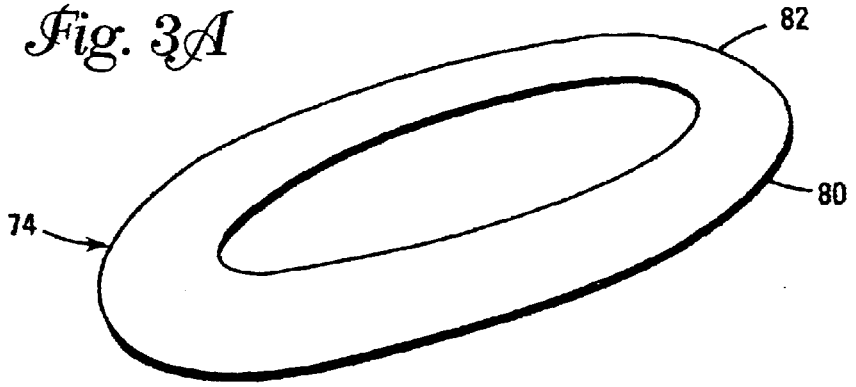
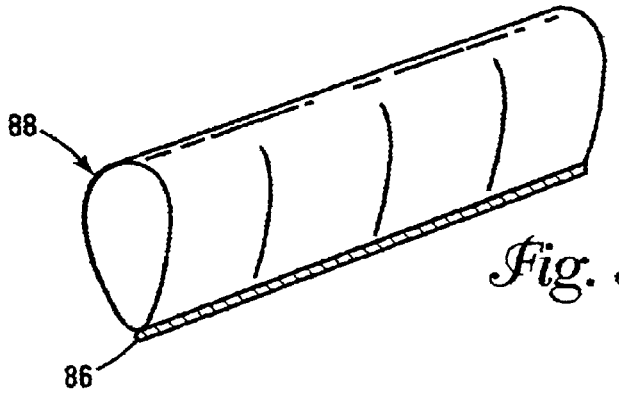
Fig. 3B
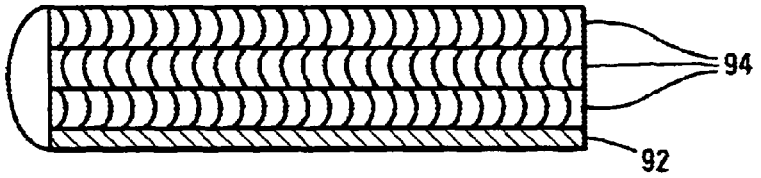
Fig. 3C

SELF-INFLATING CHILD FLOATATION DEVICE

BACKGROUND OF THE INVENTION

1. Field of the Invention

The invention relates to floatation devices for the safety of children, particularly self-inflating devices that can keep a child afloat in a safe position for an acceptable amount of time to assist in rescuing the child.

2. Background of the Art

Flotation devices have long been used for providing buoyancy for a person in the water. Flotation devices have been inflatable by a person's breath, or by pump means. Personal flotation devices are utilized for users, or particularly children, to prevent accidental drownings in swimming pools or other bodies of water, and as swimming aids. Many such flotation devices are bulky and not easily worn by the user.

U.S. Pat. No. 1,252,842 to Richardson relates to a life preserver attached about the neck, chest and back of a user by a strap arrangement. U.S. Pat. No. 3,308,494 to Licher relates to an inflatable life preserver having two portions disposable about the neck of a user, and having an automatic inflator device producing pressurized gas to inflate the life preserver. U.S. Pat. No. 4,379,705 to Saotome relates to a life belt with a tubular body and a compressed gas capsule for inflation. U.S. Pat. No. 3,952,355 to Bardebes discloses an inflatable buoyancy aid including an elongate inflatable member, gas-producing means for inflation, and securing means for fastening the buoyancy aid about the trunk of a user.

U.S. Pat. No. 4,840,591 describes an exercise device comprising a flotation jacket worn by an exerciser in water which enables the exerciser to float in an upright position while exercising and without contact with the bottom or sides of the enclosure holding the water. The jacket is fabricated from a fabric with pockets sewn in the fabric for insertion of segments of flotation material. The size and location of the segments result in equal buoyant forces at the front and back and at the sides of the exerciser to assure that the exerciser remains upright while floating in water. The fabric is such that the friction between the flotation jacket and the exerciser is increased when the fabric is immersed in water thereby preventing the jacket from riding up under the armpits of the exerciser. The flotation jacket can be fabricated easily and at low cost by using standard materials and production techniques without the need for expensive molding equipment. A buoyant support system for use in exercising is also disclosed which enables the exerciser wearing the flotation device and a harness to be supported by cables in a tank attached to the exercising device while the exerciser is floating and exercising in water placed in the tank.

U.S. Pat. No. 5,184,968 describes a one-piece swimsuit having a floatation member incorporated therein comprising a lower pants component and a two-ply upper component having neck and arm openings and a rear opening having detachable closure means, said two-ply upper portion having peripheral edges secured to each other and to said lower portion to define a closed compartment between the plies and a one-piece floatation member disposed in said compartment which extends only over the upper chest, shoulders and upper back of a wearer, said one piece floatation member having a U-shaped configuration with front and rear portions extending downwardly to an equal extent from shoulder portions and extending laterally to the same extent and having a uniform thickness, with a division in the middle of the back portion of the floatation member thereby providing greater buoyancy in the front than in the rear such that the wearer cannot remain in a prone or face down position.

Prior art Type II—Near Shore Buoyant Vests are well known. The most common are bright orange in color and have an inverted U-shape or horse shoe-shaped configuration. Frequently referred to as "life preservers" in the past, Type II vests of this type have conventionally included three connected tubular or cylindrical flotation segments or lobes. The separate lobes include a horizontal top or upper cross piece adapted to be placed behind the head and two spaced apart vertical lobes hingedly attached to opposed ends of the top piece. The front vertical lobes are adapted to pass from behind the head across the shoulders forwardly and downwardly along the chest to about the wearer's waist. A waist strap or belt connected at one end to one of the vertical lobes is passed around the wearer's waist. The free end of the belt is threaded through a belt loop provided on the other vertical lobe and fastened, usually by means of a spring clip to a belt ring provided on the other vertical lobe. The belt length usually includes a cinch buckle adjustment to shorten or lengthen the belt. A pair of aligned tie straps are usually provided at about chest height on each of the vertical lobes for forming a chest tie which effectively brings the vertical lobes together to define a neck hole or opening. These tie straps are usually made of a woven, non-slip fabric material such as cotton. More than one pair of tie straps may be provided along the front portions of the vest. In these conventional Type II flotation vests, the flotation or buoyancy is provided by a filling of flotation material filling in each of the lobes. The filling may be a closed cell foam material in chopped, molded or sheet form. Conventional life vests of this type have proven themselves useful and are perfectly adequate for most adult uses on or near the water. Nevertheless, special difficulties arise with Type II vests of this common style when the wearer is a small child or possibly a person with special needs. More particularly, each of the belt securement and tie strap structures are provided along the front of the vest which is a serious shortcoming. The frontal placement of the straps and belts permits a young child to intentionally or unintentionally undo them in use which may be very dangerous particularly in an in-the-water panic situation. The vests can only be effective if they are worn and if once properly installed they will remain in proper position on the wearer under various circumstances likely to be encountered in use.

A Type II flotation vest design generally includes a front or chest flotation portion secured to the wearer's upper body which is provided with sufficient flotation material to cause most wearers falling face first into the water to roll over into a chest-raised, back float position. The behind-the-head flotation lobe portions are intended to raise the head, face and ears of the wearer out of the water, to permit a person to remain in the water for a long period of time without becoming exhausted or drowning.

Efforts to improve upon the traditional U-shaped Type II flotation vest for children, have included providing a full vest configuration including front and back panels provided with a top neck hole and arm holes. A currently, commercially available embodiment includes a front zipper closure which separates the front flotation panel into left and right front flotation halves. These halves are bulky and in use they tend to make it difficult to install the vest on a wriggling two year old. In addition, the slide fastener hardware is placed in the front. This is a disadvantage because, the vest may tend to ride up in use, causing the zipper parts to contact the wearer's face and chin which is uncomfortable. The front placement of the closure provided on this device is also a distinct disadvantage because it can be unfastened by a young wearer.

In U.S. Pat. No. 4,038,713 another personal flotation device is described. The flotation vest described in this patent is of a Type II style and includes wrap-around front and back body panels with a rear tie closure. Front and rear flotation panels are provided in a collar structure which forces the wearer into a head-up, upright position in the water. The side portions of the vest body overlap but are open and although they define armholes, a struggling child may slip their arms in through the open sides of the vest. Moreover, a tie attachment at the rear of the vest is provided, which may disadvantageously become loosened, particularly in a panic situation. Loosening of the rear tie may cause the vest to come undone at a time when its protection is most needed.

Another prior art flotation vest is described in U.S. Pat. No. 4,380,441 to Harr et al. The flotation vest described in this patent is a front closure vest including foam back and front panels of the type used by water skiers to provide simple buoyancy. No life preservative effect of the Type II class is intended because the vest does not include a buoyant collar portion for raising the head above water. The lack of a collar section prevents the flotation vest from being self-righting in the life preserving manner of a Type II vest. The lack of a collar may cause or permit the wearer to turn turtle, i.e., to turn to a head down position in the water, without any structural means for turning rightside up. For most adult wearers who know how to swim and use their arms to tread water, these vests are adequate and are comfortable. Children may not be able to turn themselves rightside-up. The front closure for the life vest shown in the Harr et al. patent also provides a major shortcoming in connection with the use of the vest on small children or individuals with special needs, because the wearer can undo the vest or slip out of it.

U.S. Pat. No. 5,746,633 describes an inflatable personal flotation device for positioning at the shoulders of a user has front and rear float portions, automatic inflating apparatus for operation upon immersion in water, a harness comprising a belt disposed about the user, at least one shoulder strap between the belt and the float, and elastic straps between the harness and the float front and rear portions to urge downwardly thereon on the float portions in response to the weight of a user urging downwardly the central portion of the float. Hinges are preferably provided between the front and rear float portions for improved bendability therebetween. A chin strap may be provided for the user's head when the float is inflated.

U.S. Pat. No. 4,527,504 describes a safety device for quickly locating a drowning victim underwater which essentially includes a hollow cap member open at one end, a threaded spool inside the cap member and containing a water-soluble marking dye, a solid, water-soluble closure member which fits over the cap open end and is adhered to the cap member and may also be adhered to one end of the spool, and a safety pin or similar member to attach the device to a potential drowning victim, the free end of the thread extending outwardly from the cap member with its free end tied to the safety pin or other attaching member which in turn is joined to one of said cap and closure members.

U.S. Pat. No. 3,931,657 describes a personal flotation vest device comprising:

a pair of front panels and a pair of rear panels, each panel having inner and outer longitudinal edges, upper and lower edges, means securing the respective upper edges and portions of the outer longitudinal edges of a front panel and back panel together to define an armhole therebetween, means securing the inner longitudinal edges of the back panels together, and releasable closure means for releasably securing the inner longitudinal edges of the front panels together, each panel including a flexible fabric liner covering the interior surface thereof and a flexible cover covering the exterior surface thereof and secured at its periphery to the periphery of the associated fabric liner, each panel including a vertically extending sheet of buoyant material extending from adjacent the lower edge of each panel to a point adjacent the upper edge thereof and interposed between the associated liner and cover, a collar secured to said panels and including a pair of sheets of flexible fabric secured together at peripheral portions thereof, a generally U-shaped inflatable bladder formed of an elastic gas impervious material and including a pair of elongate sections and a bight portion extending between such sections said bight portion of the bladder being positioned between the sheets of said collar, each elongate section of said bladder having means thereon adjacent one longitudinal edge portion thereof attached to said closure means, and each section having means thereon adjacent its other longitudinal edge portion secured to said cover and liner.

A problem with all of these designs for floatation devices, and especially for floatation devices to be used by children is not only the fact that they are bulky and awkward to wear, the Inventor has noted that children resist wearing such floatation apparel because of their unsightliness or lack of a 'cool' appearance. Devices are rendered completely ineffective when children resist or refuse wearing the devices. It is desirable to construct a device that can support children in a safe floatation position for relatively brief, stable periods of time (e.g., for a few minutes or an hour), and thereby decrease the needed level of buoyancy required and reduce the bulk of the device. The device must be modestly visible and modestly sized to reduce annoyance to the wearer so that it is more likely to b worn by a child.

SUMMARY OF THE INVENTION

A floatation device, particularly a floatation device for children that can be easily worn, easily positioned, effective in operation, and sufficiently innocuous in appearance comprises an self-inflating tube that is worn around the neck, lies relatively flat against the wearer, and nests against the chin when inflated, without pressing tightly against the neck as would restrict breathing. The uninflated device may be plain or decorated and should respond to direct contact with water by inflating within no more than one minute of contact with water.

BRIEF DESCRIPTION OF THE FIGURES

FIG. 3*a* shows a perspective of an inflatable device that can assist in avoiding excessive compressive forces.

FIG. 3*b* shows a flexible rod on which is carried an inflatable element.

FIG. 3*c* shows a flexible expanding accordion structure that expands without elastic expansion.

DETAILED DESCRIPTION OF THE INVENTION

Many floatation devices that are marketed have an objective of being able to support a user in a drowning environment for an extended period of time. The floatation devices are able to keep wearers afloat for days if necessary. This requires the floatation devices be very sturdy, be secured to the wearer without susceptibility of accidental removal, durability in a water environment, and the like. Although these characteristics are needed for many types of floatation devices, particularly those used in water sports environments, these characteristics have been automatically carried into the field of other floatation devices where the properties conflict with the performance of the devices in other fields. Most notably, these characteristics are inappropriate for an emergency, self-inflating device for children. The bulky, sturdy, relatively large volume devices are resisted by children, primarily because of these properties. Small children resist these bulky apparel when playing around a water environment, such as a pool deck or beach area. The devices are relatively heavy, restrict the child's movement, and look geeky to other children. It is therefore necessary to provide a device that is simple, light-weight, non-obtrusive, and of neutral appearance.

The floatation device comprises a self-inflating element, such as an inflatable tube or balloon type element that can be positioned about the neck of the user without placing any significant compressive force against the neck of the wearer, during pre-inflated use or during inflated use. A non-elastic or elastic material may be used, although where there are elastic components that stretch during inflation, it is important that the design of the device prevent the stretch during inflation from exerting any discomforting force or strangling force against the next of the wearer. Preferably the device can lay flat against the chest of the wearer, with an opening and closing feature to temporarily secure the device about the wearer. The enclosure formed by the device after attachment should be smaller than the head of the wearer, preferably smaller than the circumference of the wearer's head at chin level. These and other aspects of the invention will be come more apparent by review of the figures.

Figure 1:
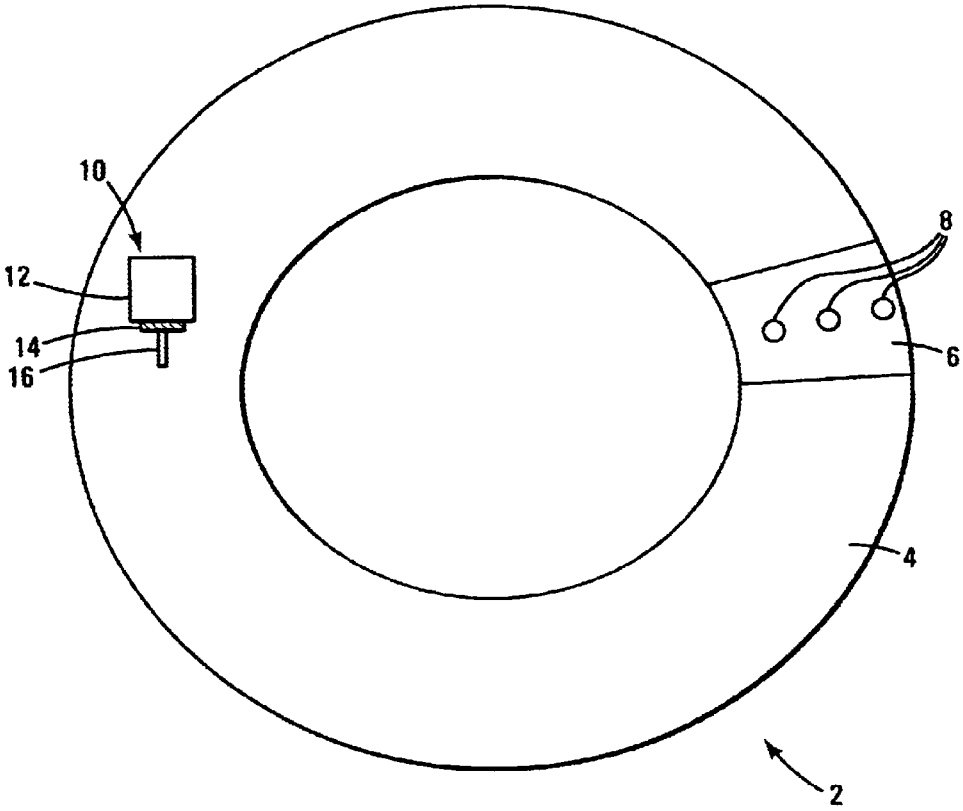
FIG. 1 shows a sample of a self-inflating floatation device for a child.

FIG. 1 shows a sample of a self-inflating floatation device 2 for a child that comprises an un-inflated tube 4 that lays flat and has a flat cross-section. A closing system 6 is shown with three snap clips 8. An automatic inflation system 10 is provided that comprises a gas-generating enclosure 12, a water-entry port 14, and a gas transport tube 16 that leads into the un-inflated tube 4. Water would enter the port 14, contact the gas-generating enclosure 12 (e.g., which for example could contain an inorganic carbonate that releases carbon dioxide upon contact with water), generate gas under pressure, the gas passing from the gas-generating enclosure through the tube 16 and passing into the inflatable tube 4 and inflating the tube 4.

Figure 2:
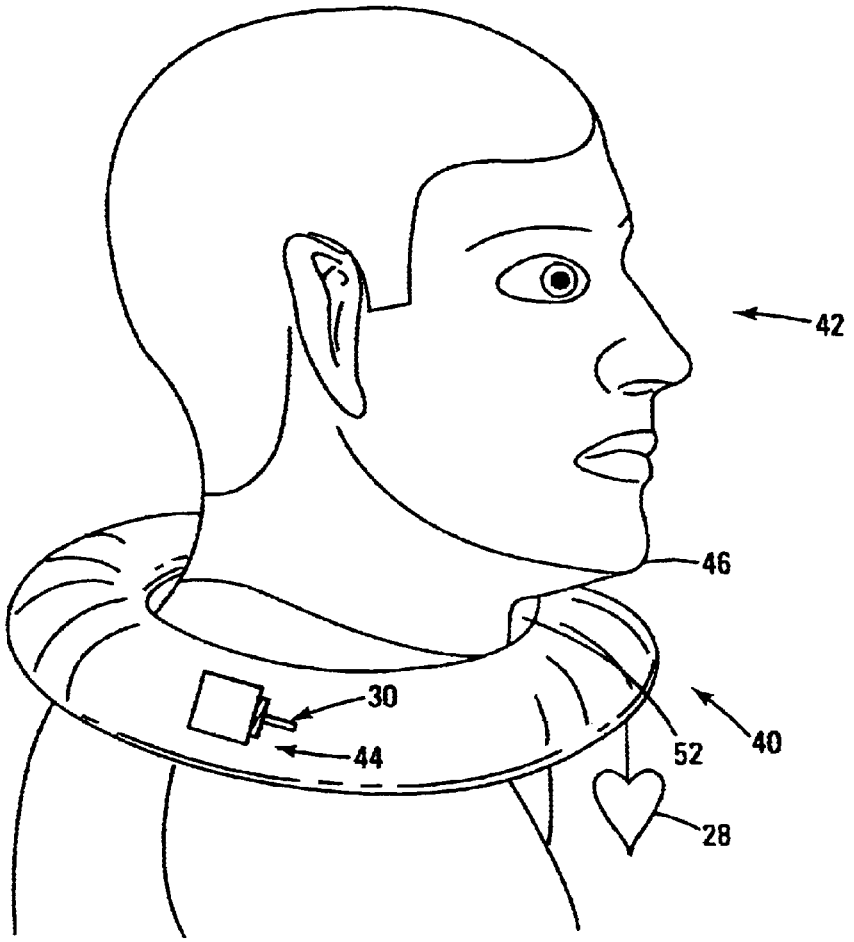
FIG. 2 shows a non-inflated floatation device worn by a child.

FIG. 2 shows a non-inflated floatation device 40 worn by a child 42. The non-inflated floatation device is shown raised off the chest of the child to show the loose fit about the neck of the child. A space 52 can thus be seen, exemplifying a non-strangling fit of the un-inflated device 40. The total diameter of the interior space 52 within the floatation device 40 should be less than the area defined by the wearer as measured at the chin and the rear of the head at chin level 46. The device can be clipped or closed into the proper fit. The inflation system 44 is also shown.

FIG. 2 shows an inflated floatation device 40 worn by a child 42. The floatation device 40 is inflated, so that the top 44 of the device 40 is in contact with the chin 46 of the wearer. The pressure against the wearer 42 caused by the inflated device 40 bottom 48 pressing against the shoulder 50 and the top 46 pressing against the chin 46 holds the device securely, yet loosely about the wearer, without any discomfort and without strangling the wearer. As can be seen in FIG. 2, there is still a space or gap 52 about the wearer, even with the firm and secure pressure applied against the chin 46 and the shoulder 50 of the wearer.

Figure 4:
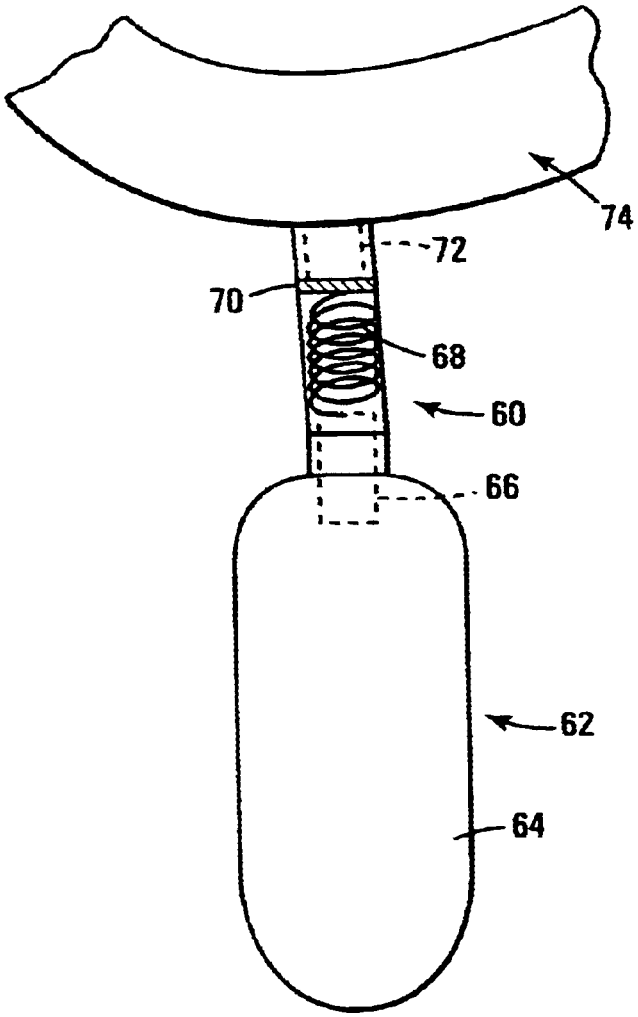
FIG. 4 shows a sample of an inflation triggering device that may be used in the practice of the invention.

FIG. 4 shows a sample of an inflation triggering device 60 that may be used in the practice of the invention. The device 60 comprises a gas cylinder 62 with a gas compartment 64. This gas compartment 64 has a slidable port valve 66 for carrying gas. The slidable valve 66 is restrained by spring 68 that is in turn held within the cylinder 62 preventing gas from being released by a water-soluble water-dispersible film 70. When water contacts this film 70, the film dissolves or disrupts, releasing the spring 68, allowing the slidable tube 66 to be forced into inflatable device port 72 so that gas enters the inflatable device 74.

Referring back to FIG. 2, other aspects of the invention can be seen. A pendant 48 can be provided on the device 40 to provide at least a decorative function to make the wearing of the device 40 more attractive to the wearer. Additionally, the pendant may contain a gas-generating system 44 with a tube 30 leading into the inflatable device 40. If there is shaping to the device 40 with a preferred front facing position, the pendant or weighted element assists in identifying the front position to the wearer. Decorations of product or character names may also be printed on the device 40 to make it more attractive to the wearer. The length of the device and its other dimensions can vary within wide limits. The number of inflatable tubes can also vary from a single tube, to multiple tubes in series or multiple tubes in parallel or a single tube wound about itself in helical fashion. The diameter of the tube when inflated should be at least one inch (2.54 cm), preferably at least 1.5 inches (3.81 cm), more preferably at least 2 inched (5.08 cm), up to a preferred maximum or 8 inches (20.4 cm) in diameter. The circumference of the tube (interior diameter) must be at least enough prior to inflation and after inflation, to clear the throat of the wearer without undue force against the throat. It may be in continuous contact with the throat, so the minimum closed dimension is that of a child's throat, approximately 10 inches (25.4 cm), usually at least 12 inches (30.5 cm) in interior circumference of the opening of the device.

FIGS. 3*a*, 3*b* and 3*c* show alternative inflatable structures that can assist in avoiding excessive compressive forces against the neck. FIG. 3*a* shows an inflated element 74 having a not expansible/non-inflatable base section 80 and an inflatable balloon section 82 over the non-inflatable base 80. This structure confines the expansion in a direction/dimension approximately perpendicular to the inflexible base 80. It is also possible to have the non-inflatable section as the interior diameter face of the inflatable tube 80, 50 that expansion occurs in only a radially outward direction. FIG. 3*b* shows a flexible rod 86 on which is carried an inflatable balloon-type element 88. The rod 86 prevents migration of the balloon 88. FIG. 3*c* shows a flexible, non-expansible base 92 having an unfolding or accordion-type structure 94 that inflates without elastic expansion.

Preventing this undue force against the throat can be assisted by the non-inflatable opening not changing its dimension by more than 10% in length when the inflatable device is inflated to 1.1 atmospheres internal pressure.

The compositions of the various elements are based almost exclusively upon structural requirements of the elements. All tube and support elements may be polymeric, elastomeric, and/or rubbery elements such as polyurethanes, silicone resins, polyamides, polyacrylates, polyesters, polyolefins, polyvinyl resins, and the like. The tube may be either a film material or a tight fabric, or a fabric reinforced film, which would also preferably be puncture resistant. An inflatable pouch within an inflatable pouch would also add some additional protection against puncture and damage during storage. The gas-releasing system would then feed both inflatable sections. Multiple, separately inflatable sections may also be provided. The gas-releasing systems and structural materials may also be provided by a wide range of structures and designs, as long as the basic format of the floatation device is maintained. The gas or pressure-providing structure may be provided as a small gas-containing cylinder or contained gas-generating composition, such as materials that rapidly produce gas upon contact with water (e.g., water-reactive materials, such as carbonates, dry acid/base mixtures, etc.). The gas-releasing system should be responsive to only contact with water, not with mere changes in humidity. Therefore the activation should be effected by contact with water, as by completion of a circuit, dissolution of a gas blocking element, dissolution of a lever block preventing gas release, and the like. The gas-releasing system should therefore not be responsive to relative humidity (e.g., the gas-release should not occur at 85° F. and 98% relative humidity for 15 minutes (up to 24 hours at this condition) which could be a typical condition in an indoor pool area). The system should be relatively enclosed so that release of the gas is into the inflatable device and not into the atmosphere. It is possible to allow two distinct paths from the gas-generating or pressurized gas container, one path to the inflatable device and the other to an audio emitter, such as an air horn. In this manner, the device would inflate to assist the child, and a sound would alert others nearby that a life-threatening event is occurring. There would be a back-restrictive feed in such a system so that the gas would not be released from the inflation section to feed the sounding of the alarm.

The device of the present invention should also be attractive to a wearer, and could be colorful, with neon colors, printed images, shape designs (e.g., have the appearance of a snake, a daisy, a bow-tie, a tattoo, a collar, a whistle, etc.), and patterns. It is also possible for the inflation action to stimulate a radio signal as an alarm to a central location.

What is claimed:

1. A device for rapid support of a person in water comprising an inflatable element, a non-inflatable base disposed below the inflatable element to limit expansion of the inflatable element, an opening for accommodating the neck of a person, the opening with a dimension of at least five inches that does not change its dimension by more than 10% in length when the inflatable device is inflated to 1.1 atmospheres internal pressure, a gas generating element, a gas transporting connection between the gas generating device and the inflatable element, a triggering device that initiates generation of gas upon activation of the device by contact with water, the inflatable element expanding to a volume having no radial dimension greater than eight inches and containing at least ten cubic inches of gas when inflated, wherein the device around the neck lies flat against the shoulders and chest of the person when the inflatable element is not inflated.

2. The device of claim 1 wherein the inflatable element contains less than eighty cubic inches of gas when inflated to atmospheric pressure wherein the gas-generating device comprises a material that produces gas when contacted with water.

3. The device of claim 1, wherein the inflatable element is contoured to lay flat against the shoulders and chest of a person when lain over the shoulders and against the chest of a person and the gas-generating device produces gas when immersed in water.

4. The device of claim 1 wherein the inflatable element expands in only two dimensions upon generation of the gas.

5. The device of claim 1 wherein gas generation is by release of gas from a compressed gas storage container.

6. The device of claim 1 wherein the gas generation is by generation of gas from contact of water with a chemical composition, the contact initiating a chemical reaction that releases gas.

7. The device of claim 6 wherein the gas generated is carbon dioxide.

8. The device of claim 1 wherein gas generation both inflates the inflatable element and drives an audio alarm.

9. A device for supporting persons in a water environment comprising an inflatable element expandable to a volume of between 10 and 80 cubic inches of gas at an internal gas pressure of 1.1 atmospheres, a non-inflatable base disposed below the inflatable element to limit expansion of the inflatable element, the inflatable element having a closing system that provides an opening within the inflatable device of at least 5 inches in diameter and less than 12 inches in diameter to accommodate the neck of a person, and the opening with a dimension of at least five inches that does not change its dimension by more than 10% in length when the inflatable device is inflated to 1.1 atmospheres internal pressure wherein the gas generating device comprises a material that produces gas when contacted with water, and wherein the device around the neck lies flat against the shoulders and chest of the person when the inflatable element is not inflated.

10. The device of claim 9 wherein the inflatable element comprises a support surface and an expansible segment, the support surface maintaining its uninflated dimensions within 10% when the expansible segment is expanded with an internal air pressure of 1.1 atmospheres.

11. The device of claim 9 wherein the inflatable element comprises a support surface and an expansible segment, the support surface maintaining its uninflated dimensions within 10% when the expansible segment is expanded with an internal air pressure of 1.1 atmospheres.

* * * * *